United States Patent [19]

Hinterman et al.

[11] Patent Number: 4,969,344

[45] Date of Patent: Nov. 13, 1990

[54] PRESS COUNTERBALANCE SYSTEM

[76] Inventors: William H. Hinterman, G-5034 Fenton Rd., Flint, Mich. 48567; Timothy W. Hinterman, 2104 Cadillac St., Flint, Mich. 48504

[21] Appl. No.: 331,242

[22] Filed: Mar. 31, 1989

[51] Int. Cl.[5] ..... B21J 9/20

[52] U.S. Cl. ..... 72/19; 72/21; 100/259

[58] Field of Search ..... 72/19, 20, 21, 453.13, 72/453.18, 7; 100/259

[56] References Cited

U.S. PATENT DOCUMENTS

| | | | |
|---|---|---|---|
| 3,416,433 | 12/1968 | Gutnikov et al. | 100/48 |
| 3,492,939 | 2/1970 | Anderson et al. | 100/214 |
| 3,557,686 | 1/1971 | Sapolsky | 100/43 |
| 4,069,697 | 1/1978 | Morrison et al. | 72/19 |
| 4,116,122 | 9/1978 | Linder et al. | 100/48 |
| 4,283,929 | 8/1981 | Heiberger | 100/48 |
| 4,308,735 | 1/1982 | Nishi | 72/21 |
| 4,418,562 | 12/1983 | Sakai et al. | 72/444 |
| 4,635,466 | 1/1987 | Seki et al. | 72/453.13 |
| 4,692,857 | 9/1987 | Chi | 72/21 |

*Primary Examiner*—David Jones

*Attorney, Agent, or Firm*—Gifford, Groh, Sprinkle, Patmore and Anderson

[57] ABSTRACT

A control system for automatic counterbalancing the ram of a mechanical press by measuring energy level of the press flywheel and varying air pressure in a counterbalancing cylinder. Energy level is derived from a measurement of the rotational speed of the counterweight at a fixed point in the ram reciprocation cycle.

13 Claims, 1 Drawing Sheet

PRESS COUNTERBALANCE SYSTEM

BACKGROUND OF THE INVENTION

1. Field of the Invention

This invention relates to a control system for mechanical presses, and, more particularly, to an automatic control system for adjusting the counterbalance for such a press.

2. Description of the Prior Art

Mechanical presses are commonly used for stamping, bending, blanking, embossing and otherwise shaping materials, usually metals. Replaceable die sets are used to do such forming with a lower die half attached to a stationery bed or platen and an upper die half attached to a ram or slide which reciprocates vertically. Typically in a mechanical press, an electric motor is used to rotate a counter weight, bringing the rotational speed of the counter weight up to a no-load equilibrium speed which will provide the proper kinetic energy to perform the forming operation. A clutch mechanism engages the flywheel which, through gears and mechanical linkage, reciprocates the ram in its working cycle using the inertia of the flywheel. Counterbalances are used to counterbalance the moving weight of the ram and its attached upper die half or punch to provide smooth operation, easier stopping, and less wear on the gears, bearings and other moving parts of the press.

Mechanical presses commonly use one or more pneumatic cylinders to perform the counterbalancing function. Typically, the air pressure is adjusted by the press operator through a manual pressure regulator when a new set of dies are put into the press to compensate for the change in the weight of the die. Usually, very little further adjustments are made of the air pressure, unless they are made pursuant to the "feel" that an experienced operator has in the efficient running of the press.

Systems have been developed for automatically adjusting the air pressure in an attempt to compensate for various effects. For example, in U.S. Pat. No. 4,283,929, the die sets, or at least the upper die or punch member is encoded so that when a new die set is put into the machine, this coding is read by the machine to automatically make an adjustment in the counterbalance air pressure to compensate for the change in the weight of the die. Other attempts have been made to automatically compensate for change in the die weight and the speed of the press by measurement of the motor current only. U.S. Pat. No. 4,069,697 teaches changing the air pressure responsive to a current signal so that adjustment for excess counterbalancing is accomplished on a down stroke and compensation for insufficient counterbalancing is done on an upstroke. Unfortunately, adjustments for die weight or motor current only solves part of the problem.

SUMMARY OF THE INVENTION

The present invention is directed to automatically adjusting the counterbalancing force provided by air pressure in compensating cylinders from a measurement of energy level of the press flywheel at a fixed point during reciprocation of the ram. This improvement and its advantages are seen in a system in which the press is operated by an electric motor and utilizes a flywheel to impart energy to reciprocate the ram. Single or multiple air operated cylinders are used to counterbalance the downward working force of the ram. A switch detects the movement of the ram at a predetermined point in the movement of the ram during its downstroke or upstroke. Preferably, the detection is made at a mid point in the downstroke or working portion of the reciprocating ram cycle. This switch preferably is a proximity switch, although other known types of switches can be used.

A sensor detects a condition which is indicative of the energy level of the flywheel. Most commonly, this is the angular velocity of the flywheel which gives an indication of this energy level. A control function is enabled by the switch and is responsive to the sensor for increasing or decreasing the air pressure in the air cylinder when this pressure is under or over counterbalancing the ram.

The control system utilizes a microprocessor which stores the no-load angular velocity of the flywheel which is when the ram is not being reciprocated. The switch determines the point at which the angular velocity of the flywheel is measured during the working cycle. When the switch is closed at a given point in the downstroke of the ram, the rotational speed measured by the sensor will be compared to the no-load speed and will initiate a control function to increase the air pressure in the counterbalancing air cylinder if the rotational speed decreases to a pre-determined value below the no-load speed. If the rotational speed is above this predetermined value, the air pressure will be decreased in the counterbalancing cylinder.

Alternatively, the instantaneous energy of the flywheel can be detected by the total power being supplied by the electric motor. This not only involves a measurement of current but also of voltage and normally the power factor should be considered. Wattage supplied to the electric motor then becomes the controlling factor and the microprocessor control can store the no-load power supplied by the electric motor.

Increases in pressure to the one or more counterbalancing cylinders being used are effected by the use of a modulating valve to increase the air supply pressure to the cylinder. Decreases in cylinder pressure are effected by using a solenoid operated valve which vents the excess pressure to atmosphere.

The foregoing advantages and others will become more apparent from the following description and the accompanying drawing.

DETAILED DESCRIPTION OF THE PREFERRED EMBODIMENTS OF THE INVENTION

Figure 1:
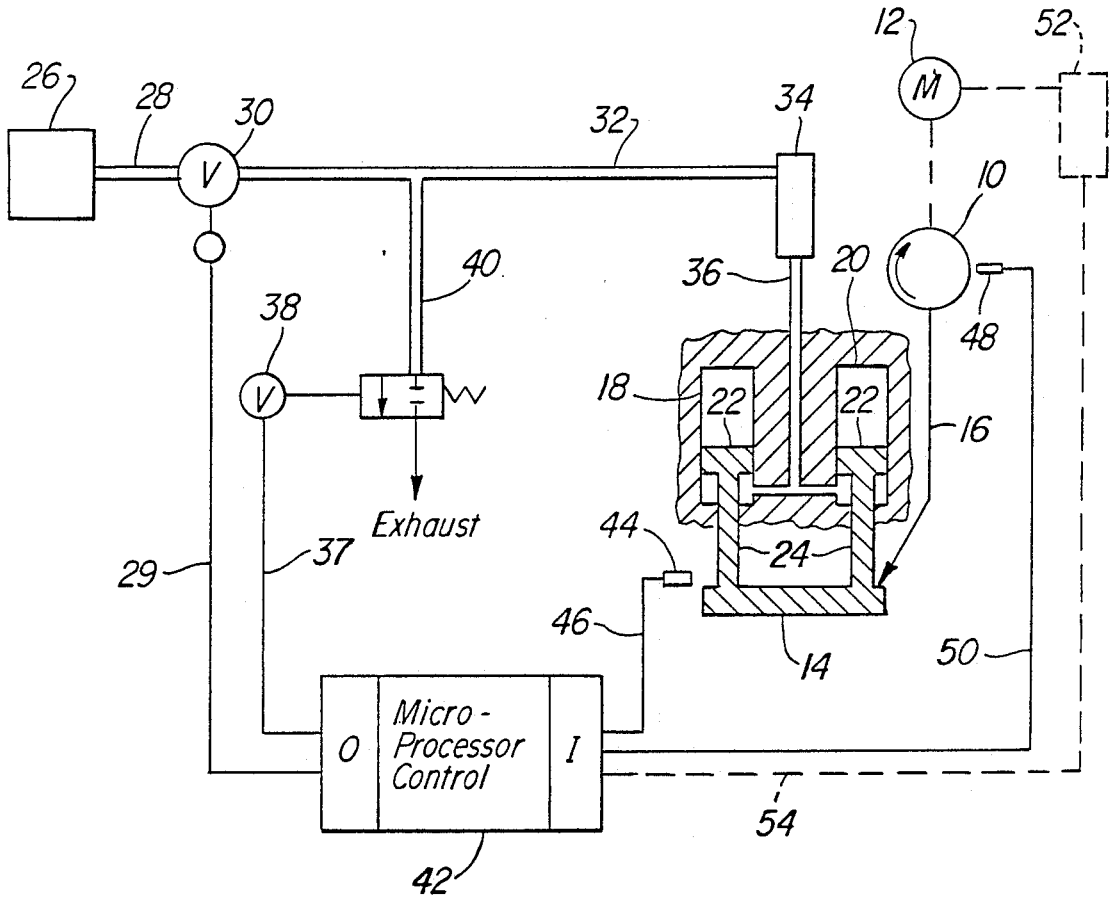
FIG. 1 is a schematic view of the control system of this invention which detects the energy level of the press flywheel at a fixed point in the working stroke of the ram to make adjustments in the air pressure value in the compensating cylinders attached to the ram.

FIG. 1 shows the control system of this invention as it is applied to the essential portions of a typical press. The press has a flywheel 10 which is driven by an electric motor 12. The flywheel, in turn, drives the press ram 14 by various mechanical linkages including clutch, gears and the like schematically shown by connection 16. The downward force of the ram in its working cycle is counterbalanced by compensating cyclinders 18 and 20 which are connected to the ram 14 through pistons 22 and piston rods 24. Compressed air is supplied to the cylinders 18 and 20 from a source 26 through line 28, modulating valve 30, line 32, surge tank 34 and line 36. Air is exhausted from cylinders 18 and 20 by solenoid operated exhaust valve 38 through air line 36 to surge tank 34, and air lines 32 and 40. It will be appreciated that other equivalent valve arrangements can be utilized with one or more equivalent counterbalancing air cylinders.

Figure 2:
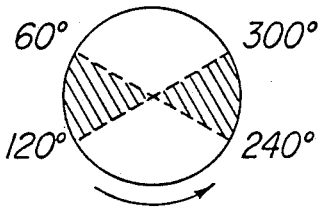
FIG. 2 is a diagram showing the preferred points for actuation of the enabling switch of the control system of this invention during the downstroke or upstroke of the ram.

Microprocessor control 42 receives control signals at I and outputs control signals at O. Proximity switch 44 detects the movement of ram 14 at a given point during its downstroke or upstroke and transmits a signal by line 46 to input I of microprocessor 42. The switch can be positioned as shown, adjacent to one of the piston rods 24 of one of the counterbalancing cylinders 18 or 20, or it may be located in any other convenient portion of the press which moves as the ram reciprocates. Typically, proximity switch 44 can detect a given point on a bull gear which is engaged when a clutch engages the flywheel 10 for reciprocation of ram 14. As shown in FIG. 2, the preferred point of engagement relative to one revolution of the flywheel which would commence at a zero degree, 12 o'clock position, would be during the downstroke between 60 and 120 degrees or during the upstroke between 240 and 270 degrees. Preferably, the point of actuation or closing of switch 44 occurs at a mid-point in the downstroke as the flywheel will be regaining energy during its upstroke.

The rotational speed of the flywheel 10 is detected by a sensing device 48 which transmits a signal to the input I of the microprocessor 42 by line 50. Sensing device 48 can be a voltage generating tachometer, a magnetic pulser or any other such device that creates an analog, digital or an electromagnetic wave signal. The no-load speed of flywheel 10 can be inputted to the microprocessor 42 by a manual switch, timer, or by any other known means in order to provide a reference signal from which a set point is generated.

The proximity switch 44 generates an enabling signal which tells the microprocessor 42 when to sample the rotational speed as continuously measured by sensor 48 to compare it against the predetermined value or set point generated in the microprocessor 42. When the switch 44 detects a travel position of the ram 14 during a working downstroke, a decrease in speed from a predetermined value indicates too much counterbalancing or excessive air pressure in the cylinders 18 and 20. The microprocessor 42 will, under these conditions, generate a signal and send it to solenoid-operated valve 38 by line 37 to exhaust a portion of the pressure of the system to atmosphere. Conversely, if the measured speed is higher than the desired predetermined value, the flywheel is underbalanced, indicating too little pressure in the cylinders 18 and 20 so that microprocessor 42 will generate a signal and send it to modulating valve 30 by line 29 to increase the pressure in the system. It also follows that if the proximity switch 44 detects a point in the upstroke of the ram 14, an increase in speed over a predetermined desired level, would indicate over counterbalancing so that the microprocessor 42 would cause solenoid valve 38 to exhaust air to atmosphere; whereas, a decrease in speed over a predetermined desired level would indicate under counterbalancing so that the microprocessor will cause an increase in the opening of modulating valve 30 to increase the pressure in the counter balance cyclinders 18 and 20.

In a modification of the control system, the energy level of the flywheel 10 can be calculated from an instantaneous measurement of the power input to the motor 12 as measured by watt meter 52 sending a signal to the input I of microprocessor control 42 by line 54. The set point reference power utilized in this mode would be taken from a measurement under no-load conditions. If the sensor 52 detects a point in the downstroke of the ram 14, a power reading which is too low in reference to the set point would indicate under counterbalancing so that the microprocessor 42 would open the valve 30 to increase the pressure being supplied to counterbalance cylinders 18 and 20. Likewise, a power value which is too high in reference to the set point level, would indicate over counterbalancing, so that the microprocessor 42 would cause the exhaust valve 38 to open.

The embodiments of the invention in which an exclusive property or privilege is claimed are defined as follows:

1. In a press operated by an electric motor and which engages a flywheel to impart energy to reciprocate a ram, said press having air-operated cylinder means for automatically counterbalancing the downward working force of said ram, an improved system for adjusting the counterbalancing air pressure in said air cylinder means according to the energy level of the flywheel comprising:

a switch detecting movement of said ram;

sensor means for detecting the rotational speed of said flywheel which is indicative of the energy level thereof; and, control means, enabled when said switch detects movement of said ram, for comparing the rotational speed of said flywheel detected by said sensor means to a predetermined value and increasing or decreasing the air pressure in said air cylinder means according to said comparison to overcome under or over counterbalancing of said ram.

2. The improved system according to claim 1 wherein said switch detects an intermediate position of the ram during its downstroke or upstroke.

3. The improved system according to claim 2 wherein said switch is a proximity switch.

4. The improved system according to claim 2 wherein said switch is activated during the downstroke of said ram enabling said control system.

5. The improved system according to claim 4 wherein said control means decreases said air pressure when said rotational speed decreases below a predetermined value.

6. The improved system according to claim 5 wherein said predetermined value is established by measuring the rotational speed of said flywheel under no-load conditions when said ram is not being reciprocated.

7. The improved system according to claim 1 wherein when said cylinder means is over counterbalancing said ram, said control means opens a solenoid-operated valve to vent said cylinder means to atmosphere to reduce said pressure.

8. The improved system according to claim 1 wherein when said cylinder means is under counterbalancing said ram, said control means actuates a modulating valve to increase the air supply pressure to said cylinder means.

9. The improved system according to claim 1 wherein said cylinder means includes a pair of pneumatic cylinders arranged to supply a force to said ram which acts to counterbalance the downward working force of said ram.

10. In a press in which a flywheel is engaged to impart energy to reciprocate a ram, said press having at least one air cylinder to counterbalance the downward working force of said ram, an automatic control system for adjusting the counterbalancing air pressure in said cylinder according to the energy level of the flywheel comprising:

a switch which is actuated during travel of said ram past a mid-point in a downward working stroke;

a speed sensor for detecting the angular velocity of said flywheel which is indicative of the energy level thereof;

valve means for increasing or decreasing the air pressure in said cylinder; and a microprocessor control system programmed to compare the angular velocity of said flywheel detected by said speed sensor to a predetermined value, and to actuate said valve means to increase or decrease the air pressure in said cylinder to automatically control the counterbalancing of said ram.

11. In a press operated by an electric motor and which engages a flywheel to impart energy to reciprocate a ram, said press having air-operated cylinder means for automatically counterbalancing the downward working force of said ram, an improved system for adjusting the counterbalancing air pressure in said air cylinder means according to the energy level of the flywheel comprising:

a switch detecting movement of said ram;

sensor means for detecting the power drawn by said electric motor which indicates the energy level of said flywheel independent of motor current which can vary with line voltage and power factor; and, control means, enabled when said switch detects movement of said ram, for comparing the power drawn by said electric motor as sensed by said sensor means to a predetermined valve and increasing or decreasing the air pressure in said air cylinder means according to said comparison to overcome under or over counterbalancing of said ram.

12. The improved system according to claim 11 wherein said switch is activated during the downstroke of said ram enabling said control means and said control means decreases said air pressure when the power supplied to said electric motor increases above a predetermined value.

13. The improved system according to claim 12 wherein said predetermined value is estabished by measuring the power being supplied to said electric motor under no-load conditions when said ram is not being reciprocated.

* * * * *